US010273655B2

(12) United States Patent
Colwell et al.

(10) Patent No.: US 10,273,655 B2
(45) Date of Patent: Apr. 30, 2019

(54) ADAPTIVE LOAD COMPENSATION FOR AN INDUSTRIAL MACHINE

(71) Applicant: Harnischfeger Technologies, Inc., Wilmington, DE (US)

(72) Inventors: Joseph J. Colwell, Hubertus, WI (US); Michael J. Linstroth, Port Washington, WI (US); Nicholas R. Voelz, West Allis, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 14/799,660

(22) Filed: Jul. 15, 2015

(65) Prior Publication Data

US 2016/0017573 A1 Jan. 21, 2016

Related U.S. Application Data

(60) Provisional application No. 62/024,789, filed on Jul. 15, 2014.

(51) Int. Cl.
*E02F 3/30* (2006.01)
*E02F 3/46* (2006.01)
(Continued)

(52) U.S. Cl.
CPC ..... *E02F 9/2029* (2013.01); *E02F 3/308* (2013.01); *E02F 3/46* (2013.01); *E02F 9/265* (2013.01)

(58) Field of Classification Search
CPC ..... E02F 9/2029
See application file for complete search history.

(56) References Cited

U.S. PATENT DOCUMENTS 6,170,681 B1 * 1/2001 Yoshimatsu ..... B66C 23/905 212/278
6,225,574 B1 * 5/2001 Chang ..... G01G 19/08 177/139
(Continued)

FOREIGN PATENT DOCUMENTS

CL 2015000135 11/2015
CN 1665696 A 9/2005
(Continued)

OTHER PUBLICATIONS

First Office Action from a Chinese Utility Modem Application from the State Intellectual Property Office of China for Application No. 201520512674.X dated Sep. 28, 2015 (3 pages).
(Continued)

*Primary Examiner* — Imran K Mustafa
(74) *Attorney, Agent, or Firm* — Michael Best & Friedrich LLP

(57) ABSTRACT

An industrial machine that includes a dipper, a crowd actuation device, a hoist actuation device, a swing actuation device, one or more sensors, and a controller. The one or more sensors generate one or more signals related to a load within the dipper. The one or more signals are received by the controller. The controller determines, based on the one or more signals, whether the industrial machine is operating in an over-loaded condition by comparing a suspended load to a suspended load threshold value. If the suspended load is greater or equal to the suspended load threshold value, the controller takes an action to control the industrial machine. The action taken by the controller can include increasing, decreasing, or otherwise modifying a speed parameter or speed limit, increasing, decreasing, or otherwise modifying a force parameter, etc.

23 Claims, 5 Drawing Sheets

(51) Int. Cl.
*E02F 9/20* (2006.01)
*E02F 9/26* (2006.01)

(56) References Cited

U.S. PATENT DOCUMENTS

| | | | | |
|---|---|---|---|---|
| 2012/0275893 | A1* | 11/2012 | Colwell | E02F 3/46 414/685 |
| 2014/0019014 | A1* | 1/2014 | Claxton | E02F 3/304 701/50 |
| 2016/0017573 | A1 | 1/2016 | Colwell et al. | |

FOREIGN PATENT DOCUMENTS

| | | | |
|---|---|---|---|
| CN | 101636542 | A | 1/2010 |
| CN | 103348065 | A | 10/2013 |
| CN | 203702148 | U | 7/2014 |

OTHER PUBLICATIONS

Office Action from the Chilean Patent Office for Application No. 2015-01998 dated May 15, 2017 (6 pages, which includes a Statement of Relevance).
Second Search Report Issued by the Chilean Patent Office for Application No. 201501998 dated Oct. 16, 2017 (6 pages Statement of Relevance Included).
Office Action issued by the Chinese Patent Office for related Application No. 201510415100.5 dated Jul. 19, 2018 (9 pages including Statement of Relevance).
Second Office Action issued from the Chinese Patent Office for related Application No. 201510415100.5 dated Jan. 23, 2019 (5 pages including Statement of Relevance).

* cited by examiner

ADAPTIVE LOAD COMPENSATION FOR AN INDUSTRIAL MACHINE

RELATED APPLICATIONS

This application claims the benefit of U.S. Provisional Patent Application No. 62/024,789, filed Jul. 15, 2014, the entire content of which is hereby incorporated by reference.

BACKGROUND

The present invention relates to controlling an industrial machine.

SUMMARY

Industrial machines, such as electric rope or power shovels, draglines, etc., are used to execute digging operations to remove material from, for example, a bank of a mine. Different industrial machines have different load or suspended load capacities that they are able to support. The suspended load capacities for industrial machines generally correspond to the weight or amount of a material within a dipper when the dipper is completely full under normal conditions (e.g., dry conditions, etc.) in addition to the weight of the dipper itself. However, under certain conditions (e.g., following rain or melting snow, a denser pocket of material, a fallen frozen lens, operator abuse, etc.), the completely full dipper of the mining material weighs more than it otherwise would. Such over-loads can apply stresses and cause strains on the industrial machine or can result in the industrial machine being incapable of safely controlling the dipper (e.g., due to the increased inertia from the load).

The invention described herein provides for the control of an industrial machine such that one or more parameters or characteristics (e.g., forces, speeds, speed limits, etc.) of the industrial machine can be controlled based on a suspended load of the industrial machine (e.g., an average suspended load, a one-time or instantaneous suspended load, etc.). By dynamically controlling the parameters based on the suspended load, the invention can reduce or mitigate the additional stresses and strains that the industrial machine would experience when operating under an over-loaded condition.

In one embodiment, the invention provides an industrial machine that includes, among other things, a dipper, a crowd actuation device, a hoist actuation device, a swing actuation device, one or more sensors, and a controller. The one or more sensors generate one or more signals related to a load within the dipper. The one or more signals are received by the controller. The controller determines, based on the one or more signals, whether the industrial machine is operating in an over-loaded condition by comparing a suspended load to a suspended load threshold value. If the suspended load is greater than or equal to the suspended load threshold value, the controller takes an action to control the industrial machine. The action taken by the controller can include, for example, increasing, decreasing, or otherwise modifying a speed parameter (e.g., crowd speed or speed limit, swing speed or speed limit, maximum speed or speed limit, etc.), increasing, decreasing, or otherwise modifying a force parameter (e.g., a crowd force, a swing force, a hoist force, etc.), etc. The control of the industrial machine is then reset when an over-load end condition is detected, such as a dipper trip being detected (i.e., dipper door is opened to dump material from the dipper), the suspended load of the dipper being reduced (e.g., material falling out of the dipper), etc.

In another embodiment, the invention provides an industrial machine that includes, among other things, a dipper, a crowd actuation device, a hoist actuation device, a swing actuation device, one or more sensors, and a controller. The one or more sensors generate one or more signals related to a load within the dipper. The one or more signals are received by the controller. The controller determines, based on the one or more signals, an average suspended load of the industrial machine. The controller then determines whether a determined or set period of time has elapsed. If the period of time has elapsed, the average suspended load is compared to an average suspended load threshold value to determine whether the industrial machine is operating in an average over-loaded condition over the period of time. If the average suspended load within the dipper is greater than or equal to the average suspended load threshold value, the controller takes an action to control the industrial machine. The action taken by the controller can include, for example, increasing, decreasing, or otherwise modifying a speed parameter (e.g., crowd speed or speed limit, swing speed or speed limit, maximum speed or speed limit, etc.), increasing, decreasing, or otherwise modifying a force parameter (e.g., a crowd force, a swing force, a hoist force, etc.), etc.

In another embodiment, the invention provides an industrial machine that includes a dipper, an actuator, a sensor, and a controller. The actuator is operable to control a movement of the dipper. The sensor is operable to generate a signal related to a weight of material in the dipper. The controller includes a processor and a memory and is programmed to receive the signal related to the weight of material in the dipper from the sensor, determine a suspended load based on the signal, compare the suspended load to a threshold value, modify a value of an operating parameter of the actuator when the suspended load is greater than the threshold value, and operate the industrial machine with the operating parameter at the modified value.

In another embodiment, the invention provides a method of controlling a movement of a dipper of an industrial machine. The method includes receiving a signal related to a weight of material in the dipper from a sensor, determining a suspended load based on the signal, comparing the suspended load to a threshold value, and modifying a value of an operating parameter of an actuator when the suspended load is greater than the threshold value. The actuator is operable to control a movement of the dipper. The method also includes operating the industrial machine with the operating parameter at the modified value.

In another embodiment, the invention provides a controller including a processor and a memory. The controller includes executable instructions stored in the memory to receive a signal related to a weight of material in the dipper from a sensor, determine a suspended load based on the signal, compare the suspended load to a threshold value, and modify a value of an operating parameter of an actuator when the suspended load is greater than the threshold value. The actuator is operable to control a movement of the dipper. The controller also includes executable instructions to generate a control signal to operate the industrial machine with the operating parameter at the modified value.

Before any embodiments of the invention are explained in detail, it is to be understood that the invention is not limited in its application to the details of the configuration and arrangement of components set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Other aspects of the invention will become apparent by consideration of the detailed description and accompanying drawings.

DETAILED DESCRIPTION

The invention described herein relates to systems, methods, devices, and computer readable media associated with controlling the operation of an industrial machine based on a suspended load of the industrial machine. For example, the industrial machine includes a control system or controller that determines and/or monitors the suspended load. The suspended load of the industrial machine includes the weight of a dipper as well as the weight of the material within the dipper. The controller is configured to determine and/or monitor the suspended load of the industrial machine for individual digging operations as well as over a period of time. If the controller determines that the suspended load at any given time (e.g., instantaneous suspended load) is greater than or equal to a threshold value (e.g., a rated suspended load ["RLS"]), the controller can control the industrial machine based on the suspended load. For example, the controller is configured to modify (e.g., limit) the speed (e.g., crowd speed or speed limit, hoist speed or speed limit, swing speed or speed limit, maximum speed or speed limit, etc.) that the dipper is allowed to move. The controller is also configured to modify (e.g., increase) a force applied to the dipper (e.g., crowd force, hoist force, swing force, etc.) to provide for more precise control of the overloaded dipper in light of the added inertia of the suspended load. The controller is also configured to control the operation of the industrial machine if an average suspended load over a determined or set period of time is greater than or equal to an average suspended load threshold value. For example, the industrial machine, over a given period of time, may experience some suspended loads that are overloaded and some that are not overloaded. However, if the average suspended load that the industrial machine experiences within a period of time is high, cyclical and repetitive stresses on the industrial machine can cause damage. As a result, if the average suspended load that the industrial machine experiences for a given time period exceeds the average suspended load threshold value, the operation of the industrial machine can be controlled to limit the stresses that the industrial machine experiences by modifying (e.g., limiting) the speed that the dipper is allowed to move and modifying (e.g., increasing) forces applied to the dipper. Such control of the industrial machine when an overload condition is present (instantaneous or average) can reduce the stresses and strains that the industrial machine experiences and prolong the operational life of the industrial machine.

Figure 1:
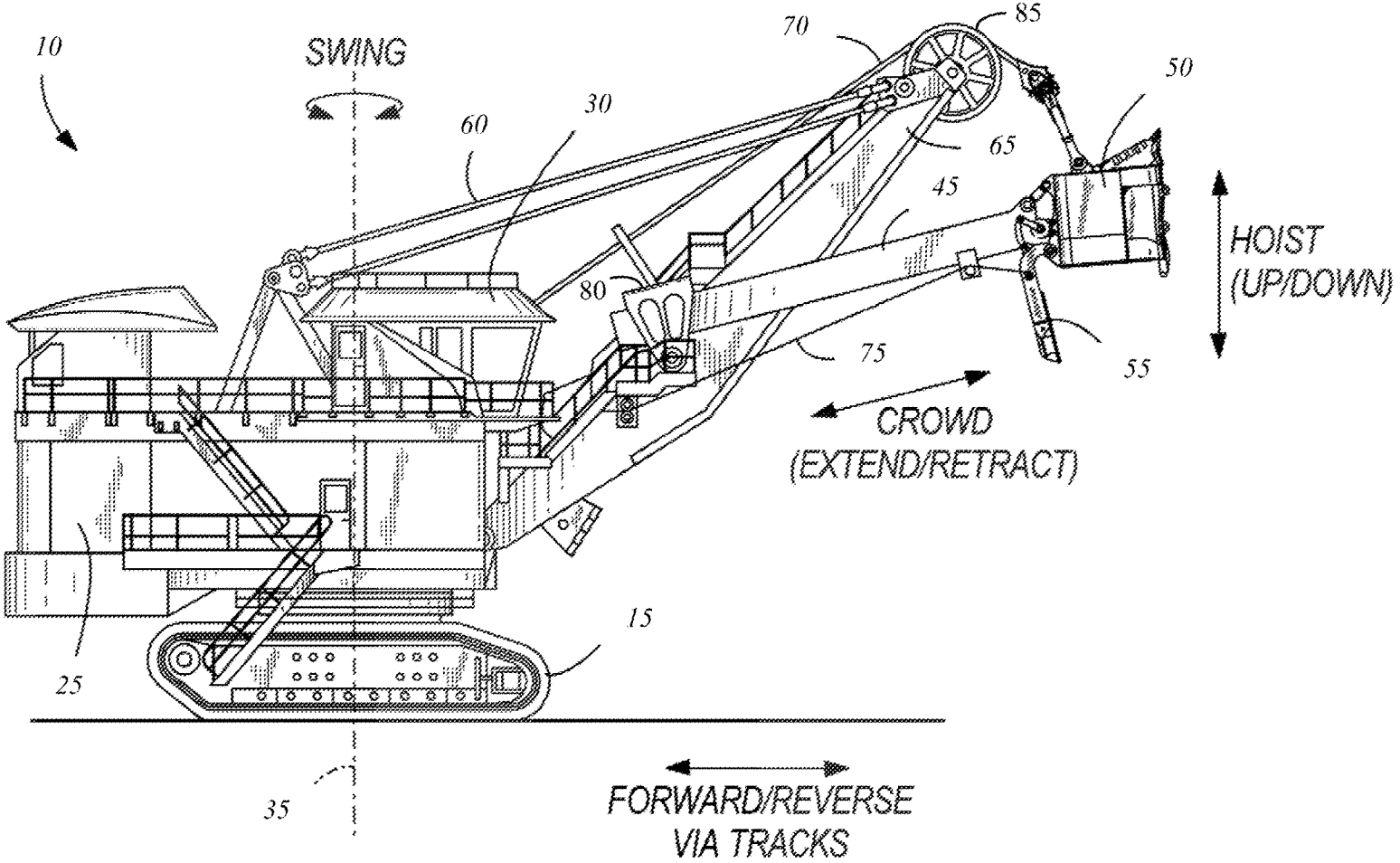
FIG. 1 illustrates an industrial machine according to an embodiment of the invention.

Although the invention described herein can be applied to, performed by, or used in conjunction with a variety of industrial machines (e.g., a rope shovel, a dragline, AC machines, DC machines, hydraulic machines, etc.), embodiments of the invention described herein are described with respect to an electric rope or power shovel, such as the power shovel 10 shown in FIG. 1. The industrial machine 10 includes tracks 15 for propelling the industrial machine 10 forward and backward, and for turning the industrial machine 10 (i.e., by varying the speed and/or direction of left and right tracks relative to each other). The tracks 15 support a base 25 including a cab 30. The base 25 is able to swing or swivel about a swing axis 35, for instance, to move from a digging location to a dumping location. Movement of the tracks 15 is not necessary for the swing motion. The industrial machine 10 further includes a pivotable dipper handle 45 and dipper 50. The dipper 50 includes a door 55 for dumping the contents of the dipper 50.

The industrial machine 10 includes suspension cables 60 coupled between the base 25 and a boom 65 for supporting the boom 65. The industrial machine also includes a wire rope or hoist cable 70 attached to a winch and hoist drum (not shown) within the base 25 for winding the hoist cable 70 to raise and lower the dipper 50, and a crowd cable 75 connected between another winch (not shown) and the dipper door 55. The industrial machine 10 also includes a saddle block 80, a sheave 85, and gantry structures 90. In some embodiments, the industrial machine 10 is a P&H® 4100 series shovel produced by Joy Global Inc.

Figure 2:
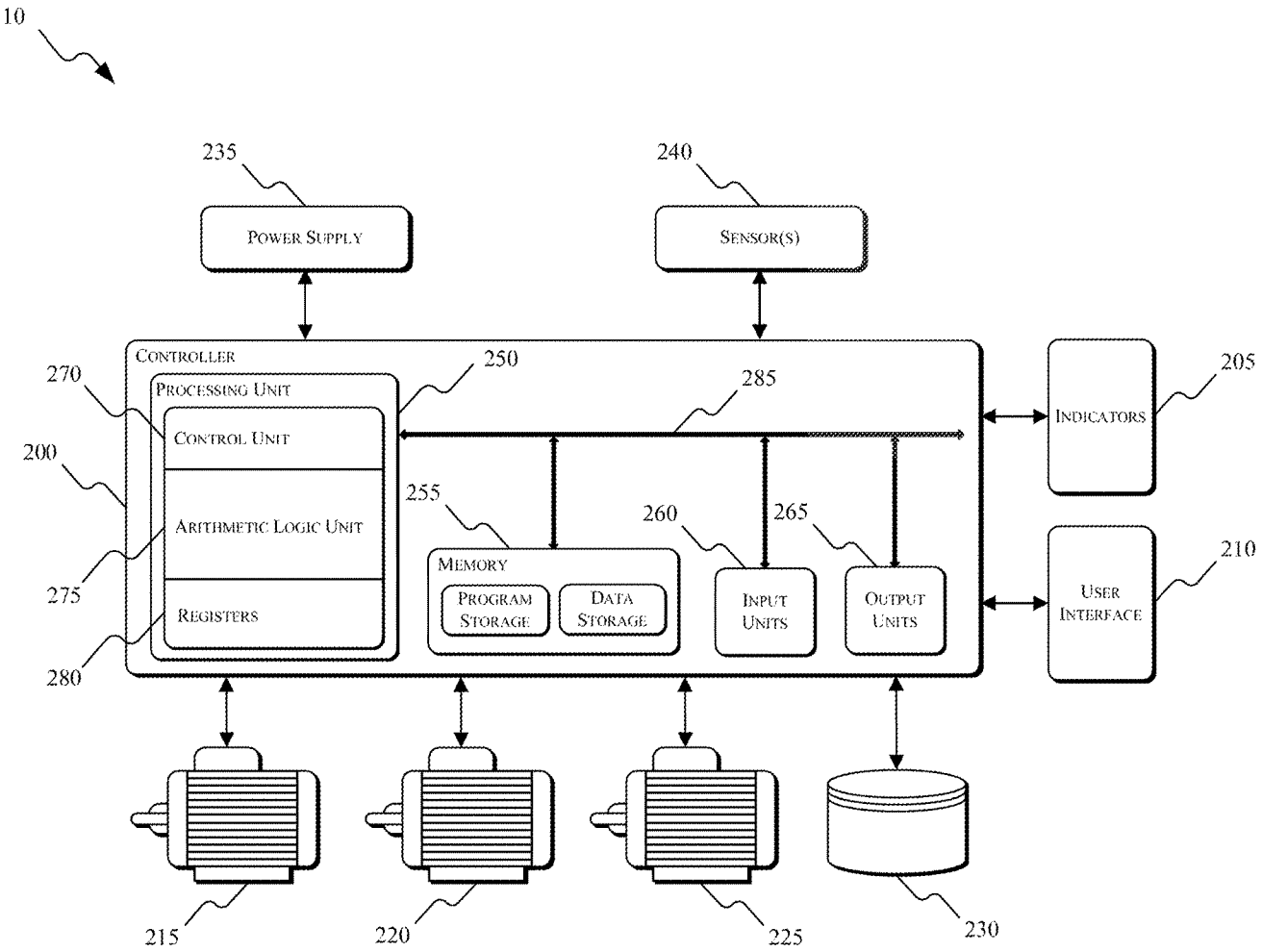
FIG. 2 illustrates a control system of the industrial machine of FIG. 1 according to an embodiment of the invention.

FIG. 2 illustrates a controller 200 associated with the industrial machine 10 of FIG. 1. The controller 200 is electrically and/or communicatively connected to a variety of modules or components of the industrial machine 10. For example, the illustrated controller 200 is connected to one or more indicators 205, a user interface module 210, one or more hoist actuation devices (e.g., motors, hydraulic cylinders, etc.) and hoist drives 215, one or more crowd actuation devices (e.g., motors, hydraulic cylinders, etc.) and crowd drives 220, one or more swing actuation devices (e.g., motors, hydraulic cylinders, etc.) and swing drives 225, a data store or database 230, a power supply module 235, and one or more sensors 240. The hoist actuation devices and drives 215, the crowd actuation devices and drives 220, and the swing actuation devices and drives 225 are configured to receive control signals from the controller 200 to control hoisting, crowding, and swinging operations of the industrial machine 10. The controller 200 includes combinations of hardware and software that are configured, operable, and/or programmed to, among other things, control the operation of the industrial machine 10, control the position of the boom 65, the dipper handle 45, the dipper 50, etc., activate the one or more indicators 205 (e.g., a liquid crystal display ["LCD"]), monitor the operation of the industrial machine 10, etc. The one or more sensors 240 include, among other things, a loadpin, a strain gauge, one or more inclinometers, gantry pins, one or more motor field modules (e.g., measuring motor parameters such as current, voltage, power, etc.), one or more rope tension sensors, one or more resolvers, etc. In some embodiments, a crowd drive other than a crowd motor drive can be used (e.g., a crowd drive for a single legged handle, a stick, a hydraulic cylinder, etc.).

In some embodiments, the controller 200 includes a plurality of electrical and electronic components that provide power, operational control, and protection to the components and modules within the controller 200 and/or industrial machine 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor chip, is a field-programmable gate array ("FPGA"), is an application specific integrated circuit ("ASIC"), etc.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the industrial machine 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The power supply module 235 supplies a nominal AC or DC voltage to the controller 200 or other components or modules of the industrial machine 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or industrial machine 10. In other constructions, the controller 200 or other components and modules within the industrial machine 10 are powered by one or more batteries or battery packs, or another grid-independent power source (e.g., a generator, a solar panel, etc.).

The user interface module 210 is used to control or monitor the industrial machine 10. For example, the user interface module 210 is operably coupled to the controller 200 to control the position of the dipper 50, the position of the boom 65, the position of the dipper handle 45, etc. The user interface module 210 includes a combination of digital and analog input or output devices required to achieve a desired level of control and monitoring for the industrial machine 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the industrial machine 10 in real-time or substantially real-time. For example, the user interface module 210 is configured to display measured electrical characteristics of the industrial machine 10, the status of the industrial machine 10, the position of the dipper 50, the position of the dipper handle 45, etc. In some implementations, the user interface module 210 is controlled in conjunction with the one or more indicators 205 (e.g., LEDs, speakers, etc.) to provide visual or auditory indications of the status or conditions of the industrial machine 10.

Figure 3:
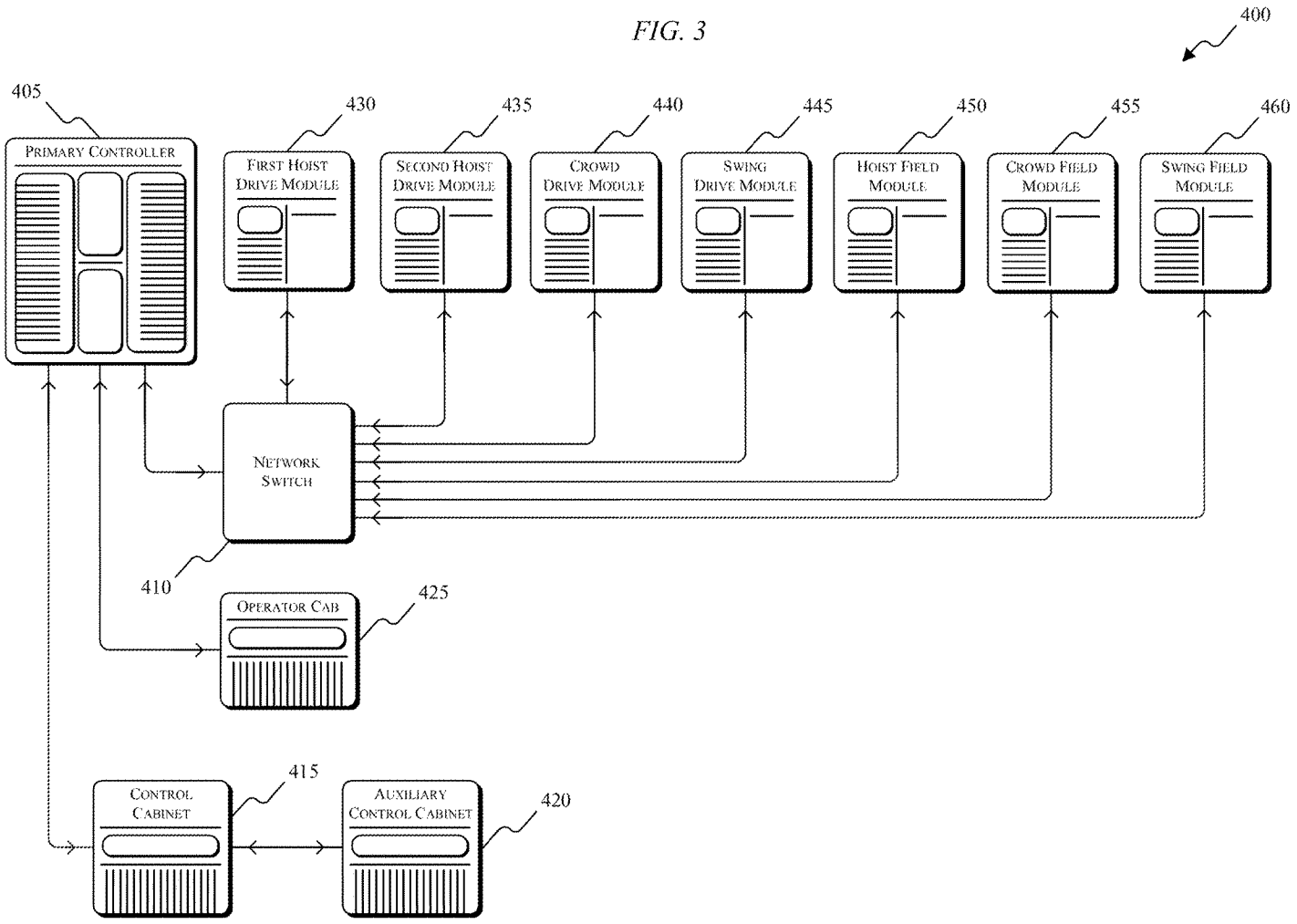
FIG. 3 illustrates a control system of the industrial machine of FIG. 1 according to another embodiment of the invention.

FIG. 3 illustrates a more detailed control system 400 for the industrial machine 10. For example, the industrial machine 10 includes a primary controller 405, a network switch 410, a control cabinet 415, an auxiliary control cabinet 420, an operator cab 425, a first hoist drive module 430, a second hoist drive module 435, a crowd drive module 440, a swing drive module 445, a hoist field module 450, a crowd field module 455, and a swing field module 460. The various components of the control system 400 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc.

The control system 400 can include the components and modules described above with respect to FIG. 2. For example, the one or more hoist actuation devices and/or drives 215 correspond to first and second hoist drive modules 430 and 435, the one or more crowd actuation devices and/or drives 220 correspond to the crowd drive module 440, and the one or more swing actuation devices and/or drives 225 correspond to the swing drive module 445. The user interface 210 and the indicators 205 can be included in the operator cab 425, etc. A strain gauge, an inclinometer, gantry pins, resolvers, etc., can provide electrical signals to the primary controller 405, the controller cabinet 415, the auxiliary cabinet 420, etc.

The first hoist drive module 430, the second hoist drive module 435, the crowd drive module 440, and the swing drive module 445 are configured to receive control signals from, for example, the primary controller 405 to control hoisting, crowding, and swinging operations of the industrial machine 10. The control signals are associated with drive signals for hoist, crowd, and swing actuation devices 215, 220, and 225 of the industrial machine 10. As the drive signals are applied to the actuation devices 215, 220, and 225, the outputs (e.g., electrical and mechanical outputs) of the actuation devices are monitored and fed back to the primary controller 405 (e.g., via the field modules 450-460). The outputs of the actuation devices include, for example, positions, speeds, torques, powers, currents, pressures, etc. Based on these and other signals associated with the industrial machine 10, the primary controller 405 is configured to determine or calculate one or more operational states or positions of the industrial machine 10 or its components. In some embodiments, the primary controller 405 determines a dipper position, a dipper handle angle or position, suspended load, dipper payload, a hoist rope wrap angle, a hoist speed, a number of dead wraps, a crowd speed, a dipper speed, swing speed, a dipper acceleration, a CG excursion (e.g., with respect to axis 35), a tipping moment, total gantry load (e.g., total gantry structural loading), etc.

The processes 500 (FIG. 4) and 600 (FIG. 5) are associated with and described herein with respect to a digging operation of the industrial machine 10 and speeds (e.g., crowd speeds and speed limits, swing speeds and speed limits, maximum speeds and speed limits, etc.) and forces (e.g., crowd forces, swing forces, etc.) applied by the industrial machine 10 while the dipper 50 is being moved from a dig position to a dump position. Various steps described herein with respect to the processes 500 and 600 are capable of being executed simultaneously, in parallel, or in an order that differs from the illustrated serial manner of execution. The processes 500 and 600 may also be capable of being executed using fewer steps than are shown in the illustrated embodiment. Additionally, although the processes 500 and 600 are described separately, the controller 200 is operable to execute the process 500 and 600 at the same time or in tandem. As such, the controller 200 would be configured to monitor the suspended load of the industrial machine for both one-time or instantaneous suspended loads as well as average suspended loads over time.

Figure 4:
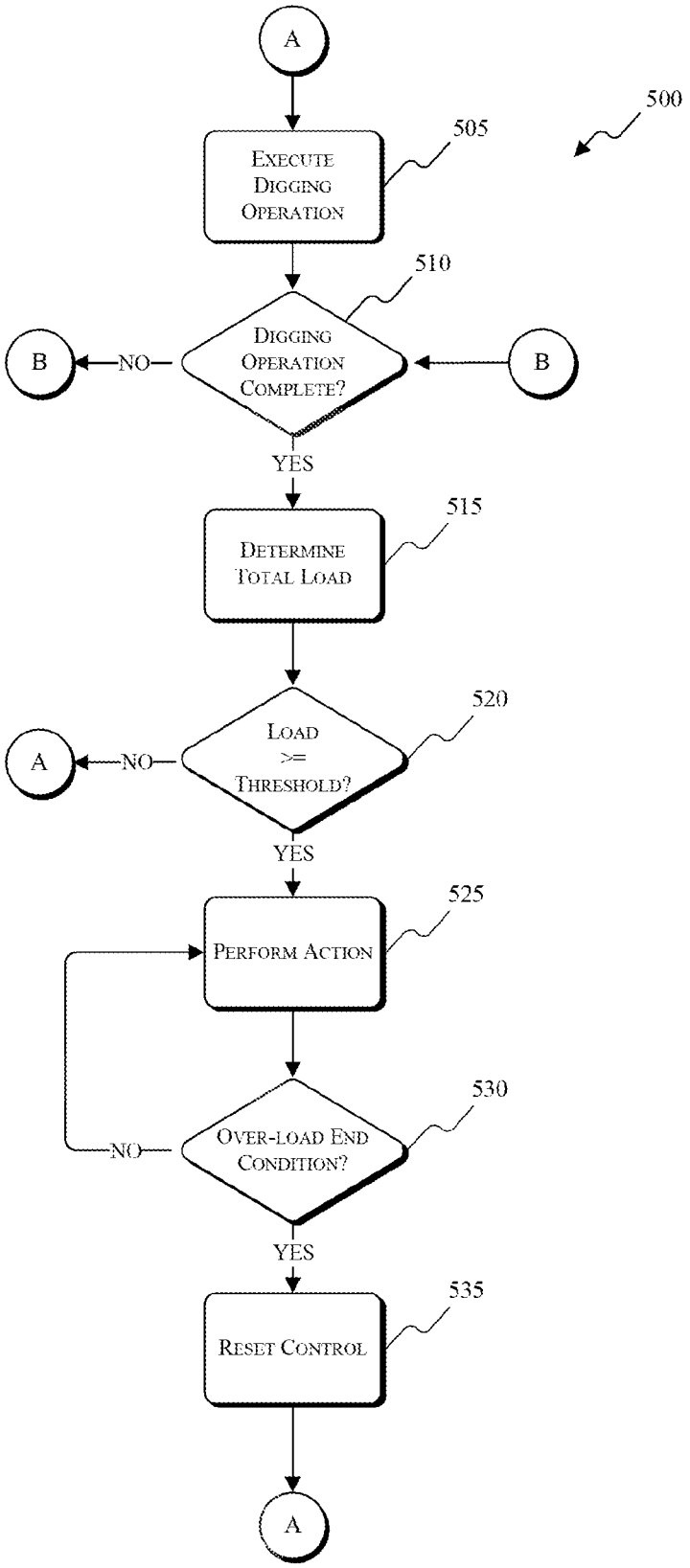
FIG. 4 is a process for controlling an industrial machine based on a load in a dipper.

The process 500 shown in FIG. 4 begins with the execution of a digging operation (step 505). A digging operation includes, for example, an industrial machine moving from a tuck position to engage a bank to remove material from the bank. Through a combination of hoist and crowd motions, the dipper 50 is filled with material. When the dipper 50 is filled with material and the industrial machine 10 has completed its hoist and crowd motions to fill the dipper 50, the digging operation is complete. At step 510, the controller 200 determines whether the digging operation is complete. If the digging operation is not complete, the process 500 remains at step 510 until the industrial machine completes the digging operation. When the digging operation is complete at step 510, the controller determines a suspended load or total suspended load of the industrial machine (step 515). In some embodiments, suspended load is the combination of the weight of the dipper 50 and the weight of the material or payload within the dipper 50. In other embodiments, suspended load is the combination of the weight of the dipper 50, the weight of the material or payload within the dipper 50, and the weight of the dipper handle 45. The weight of the dipper 50 is substantially fixed for a given dipper 50. However, the dipper 50 can, for example, be reinforced with metal, which modifies the weight of the dipper 50. Stored values for the weight of the dipper can be updated as needed (e.g., once per week) to account for variations in the weight of the dipper 50. The payload within the dipper is variable from one digging operation to another. The payload within the dipper 50 can be determined in a variety of ways. For example, the payload load can be determined using a loadpin, a strain gauge, motor parameters (e.g., current, voltage, torque, power, etc.), rope tension, and the like. Techniques for determining or calculating a payload within a dipper 50 are known in the art, such as the use of a loadpin, a strain gauge, or another sensor to measure a vertical force associated with the load with the dipper. The sensor can be calibrated such that its output signal is related to the force from the payload within the dipper. The measured force can be used to determine or calculate the weight of the payload in the dipper 50. The measured payload force acting on the dipper 50 plus the weight of the dipper 50 itself provides an indication of the suspended load of the industrial machine. In some embodiments, the payload within the dipper is determined using techniques similar to those described in U.S. Pat. No. 8,788,245, titled "SYSTEMS AND METHODS FOR ACTIVELY BIASING A LOADPIN," the entire content of which is hereby incorporated by reference.

After the suspended load has been determined at step 515, the suspended load is compared to a suspended load threshold value (step 520). The suspended load threshold value corresponds to a suspended load that is greater than or equal to a rated or expected maximum load for the industrial machine 10, or a suspended load that, due to the weight of the suspended load, could produce additional or added stresses on the industrial machine. In some embodiments, the suspended load threshold value is a rated suspended load ("RSL") or target payload for an industrial machine which is fixed (e.g., independent of the type of dipper attached to the industrial machine) and not to be exceeded. With respect to RSL, a lighter dipper allows for more payload weight in the dipper, while a heavier dipper allows for less payload weight in the dipper. In some embodiments, the suspended load threshold value corresponds to a percentage of a desired maximum rated suspended load (e.g., 105%, 110%, 120%, between 100% and 200%, greater than 100%, etc.). In other embodiments, the suspended load threshold value corresponds to a weight (e.g., in pounds or tons) of the suspended load, a tension on a hoist rope, or a force or torque generated by an actuation device, etc.

If the suspended load is greater than or equal to the suspended load threshold value, the industrial machine 10 performs an action (step 525). The action performed by the industrial machine can include, for example, one or more modifications to force values, speed values or speed limits, position values, ramp rates, etc. In some embodiments, the controller 200 reduces the swing speed of the dipper 50, reduces the crowd speed of the dipper 50, reduces lowering speed, increases crowd generating force (e.g., crowd motor torque), and/or increases hoist generating force (e.g., hoist motor torque). The values for these parameters can be modified (e.g., increased or decreased) based on the suspended load. For example, the values can by modified to a set point or by a percentage or a ratio that is based on how much the suspended load exceeded the suspended load threshold value. As an illustrative example of such control, if the suspended load exceeded the suspended load threshold value by 15%, the crowd, hoist, and maximum speed or speed limits could all be reduced by 15% and the crowd force and hoist force could both be increased by 15%.

In some embodiments, the controller 200 can also set or apply brakes to prevent the dipper from being moved. For example, when the industrial machine completes a digging operation and the dipper has just exited the bank, the dipper is still in a position where the contents of the dipper could be dumped without causing safety concerns. In the event of a severe overload, the contents of the dipper 50 may need to be dumped before a swing operation is initiated. As such, the brakes are set to prevent the industrial machine from swinging the dipper 50 and the contents of the dipper 50 are dumped. The contents of the dipper 50 can be dumped automatically (i.e., without action from an operator) or dumped manually by the operator. If the dipper contents are dumped manually, the operator is notified of the overload condition and that the brakes have been applied to prevent a swinging motion. To release the brakes, the operator then opens the dipper door 55 to release the contents of the dipper 50. Once the contents of the dipper have been released, the brakes are released and the operator is able to initiate a new digging operation. Additionally or alternatively to the above control, when an overloaded dipper condition occurs, the operator can be notified of the overload and the operator can take action to reduce speeds and increase forces correspondingly.

At step 530, the controller 200 determines whether an over-load end condition has occurred, such as a dipper trip, a reduction in suspended load, etc., and the industrial machine can be safely operated under normal operating conditions. A dipper trip condition occurs when an operator activates an input device (e.g., a switch, a button, a lever, etc.) that causes the dipper door 55 of the dipper 50 to be opened and, as a result, empty the load of material within the dipper (e.g., into a dump truck). A reduction in suspended load may occur when, for example, material from an overloaded dipper spills over the sides of the dipper. If, at step 530, the over-load end condition has not occurred, the process 500 returns to step 525 where the action is continued to be performed by the industrial machine 10. If, at step 530, the overload end condition has occurred, the controller 200 resets the control of the industrial machine to normal operating conditions. Specifically, if a speed or torque value was modified at step 525, that speed or torque value can be reset to a normal operational value. As an illustrative example, if a crowd speed or swing speed value or limit is reduced (e.g., to 80% from a 100% maximum crowd or swing speed), the crowd speed or swing speed value is reset to the 100% maximum crowd or swing speed. Similarly, if a torque value or position value were modified, those modified values would be reset to their previous or normal operating values. After the control of the industrial machine has been reset at step 535, the process 500 returns to step 505 and awaits a subsequent digging operation to be initiated.

Figure 5:
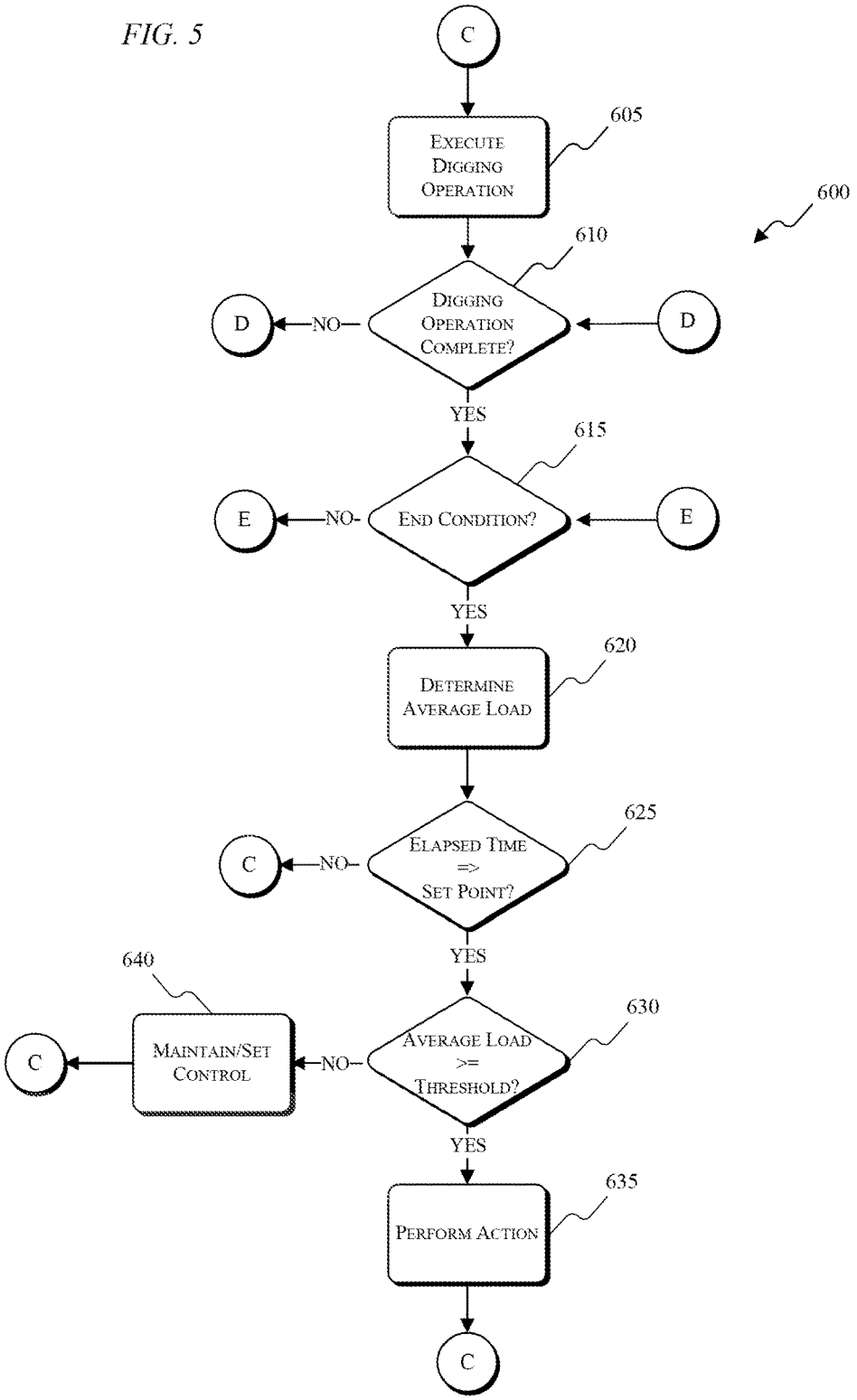
FIG. 5 is another process for controlling an industrial machine based on a load in a dipper.

The process 600 shown in FIG. 5 begins with the execution of a digging operation (step 605). At step 610, the controller 200 determines whether the digging operation is complete. If the digging operation is not complete, the process 600 remains at step 610 until the industrial machine completes the digging operation. When the digging operation is complete at step 610, the controller 200 determines whether an end condition (e.g., a digging end condition) has occurred, such as a dipper trip condition or another condition that signals the controller 200 to determine average suspended load of the industrial machine. If, at step 615, the end condition has not occurred, the process 600 remains at step 615 until the dipper trip has occurred. If, at step 615, the end condition has occurred, the controller 200 determines an average suspended load within a specified period of time (step 620). For example, the average suspended load is a rolling average and can be determined by summing the values for the suspended load over a predetermined period of time and dividing the sum by the number of digging operations that were performed. In some embodiments, the average suspended load is determined by averaging the suspended loads over a predetermined number of digging cycles (e.g., 10 digging cycles, 20 digging cycles, 30 digging cycles, etc.) which correspond to all or a portion of the number of digging cycles that typically occur during a given period (e.g., 1 hour, 6 hours, 8 hours, 12 hours, 24 hours, etc.).

After the average suspended load has been determined at step 620, the controller 200 determines whether an amount of elapsed time is equal to or greater than a time set point or time period (step 625). The set point corresponds to an interval of time over which the average suspended load is to be monitored. In some embodiments, the interval of time may be between one hour and 12 hours. In other embodiments, the interval of time may be between 0.5 hours and 24 hours, 48 hours, 72 hours, etc. If the time set point has not been reached, the process returns to step 605 for a subsequent digging operation to be performed by the industrial machine 10. If, at step 625, the time set point has been reached, the controller 200 compares the average suspended load to an average suspended load threshold value (step 630). The average suspended load threshold value is similar to the suspended load threshold value described above with respect to the process 500. However, the average suspended load threshold value corresponds to a value for an average suspended load that can cause adverse stresses and strain on the industrial machine over a given period of time. In some embodiments, the average suspended load threshold value is less than the suspended load threshold value because the one-time or instantaneous suspended loads that the industrial machine can withstand are greater than the repeated or continuous suspended loads that the industrial machine can withstand. In other embodiments, the average suspended load threshold value and the suspended load threshold value are approximately the same.

If the average suspended load is greater than or equal to the suspended load threshold value, the industrial machine 10 performs an action (step 635). The action performed by the industrial machine can include, for example, one or more modifications to force values, speed values or limits, position values, etc., as described above with respect to the process 500. If the average suspended load is less than the average suspended load threshold value, the controller 200 maintains or sets the control of the industrial machine 10 to current or new operating conditions (640). Because the average suspended load is calculated as a rolling average, each time the average is compared to the average suspended load threshold at step 630 new controls are determined. If the average suspended load has increased, the above-described controls are applied more strictly to account for the increase in average suspended load. If the average suspended load has decreased, the operation of the industrial machine 10 approaches the normal operating conditions. Such a control technique allows for the continued operation of the industrial machine 10 as well as a reduction or mitigation of the effects of the increased suspended load on the industrial machine 10. After the control of the industrial machine has been maintained or set at step 640, the process 600 returns to step 605 and awaits a subsequent digging operation to be initiated.

Thus, the invention provides, among other things, systems, methods, devices, and computer readable media for dynamically controlling the operation of an industrial machine based on a suspended load of the industrial machine. Various features and advantages of the invention are set forth in the following claims.

What is claimed is:

1. A method of controlling a movement of a dipper of an industrial machine, the method comprising:

receiving a signal related to a weight of material in the dipper from a sensor;

determining a suspended load associated with the dipper based on the signal;

in response to detecting a severe overloaded dipper condition based on the suspended load associated with the dipper, performing a predetermined action;

in response to not detecting a severe overloaded dipper condition, comparing the suspended load associated with the dipper to a threshold value, the threshold value representing an overloaded dipper condition;

automatically increasing a force value applied by an actuator operable to control a movement of the dipper in response to the suspended load associated with the dipper being greater than the threshold value;

operating the industrial machine with the increased force value; and in response to detecting an end of the overloaded dipper condition, automatically reducing the increased force value.

2. The method of claim 1, wherein the actuator is selected from the group consisting of a swing actuator and a hoist actuator.

3. The method of claim 2, wherein the actuator is a motor.

4. The method of claim 3, wherein the force value of the motor is a torque of the motor.

5. The method of claim 1, wherein automatically reducing the increased force value includes automatically reducing the increased force value in response to receiving a second signal related to a dipper trip condition of the industrial machine from a second sensor, wherein the second signal indicates the end of the overloaded dipper condition.

6. The method of claim 5, wherein receiving the second signal related to the dipper trip condition of the industrial machine includes receiving a second signal indicating a dipper door opening.

7. The method of claim 1, wherein the suspended load associated with the dipper is an average suspended load of the dipper.

8. The method of claim 1, further comprising:

determining whether an operation of the industrial machine is complete, wherein determining the suspended load associated with the dipper includes determining the suspended load associated with the dipper when the operation of the industrial machine is complete.

9. The method of claim 1, wherein performing the predetermined action includes applying brakes of the industrial machine and releasing the brakes of the industrial machine when the material in the dipper has been released.

10. An industrial machine comprising:

a dipper;

an actuator operable to control a movement of the dipper;

a sensor operable to generate a signal related to a weight of material in the dipper; and a controller including a processor and a memory and programmed to receive the signal related to the weight of material in the dipper from the sensor, determine a suspended load associated with the dipper based on the signal, in response to detecting a severe overload dipper condition based on the suspended load associated with the dipper, performing a predetermined action, in response to not detecting a severe overload dipper condition, compare the suspended load associated with the dipper to a threshold value, the threshold value representing an overloaded dipper condition, automatically increase a force value applied by the actuator in response to the suspended load associated with the dipper being greater than the threshold value, operate the industrial machine with the increased force value; and in response to detecting an end of the overload dipper condition, automatically reduce the increased force value.

11. The industrial machine of claim 10, wherein the actuator is a swing actuator.

12. The industrial machine of claim 11, wherein the swing actuator is a swing motor.

13. The industrial machine of claim 12, wherein the force of the swing motor is a torque of the swing motor.

14. The industrial machine of claim 10, wherein the actuator is a hoist actuator.

15. The industrial machine of claim 14, wherein the hoist actuator is a hoist motor.

16. The industrial machine of claim 15, wherein the force value of the hoist motor is a torque of the hoist motor.

17. The industrial machine of claim 10, further comprising a second sensor operable to generate a second signal related to a dipper trip condition of the industrial machine.

18. The industrial machine of claim 17, further comprising a dipper door, and wherein the trip condition is the dipper door opening.

19. The industrial machine of claim 10, wherein the suspended load associated with the dipper is an average suspended load of the dipper.

20. A controller including a processor and a memory, the controller comprising executable instructions stored in the memory to:

receive a signal related to a weight of material in a dipper from a sensor;

determine a suspended load associated with the dipper based on the signal;

in response to detecting a severe overloaded dipper condition based on the suspended load associated with the dipper, perform a predetermined action; and in response to not detecting a severe overloaded dipper condition, compare the suspended load associated with the dipper to a threshold value, the threshold value representing an overloaded dipper condition, automatically increase a force value applied by an actuator operable to control a movement of the dipper in response to the suspended load associated with the dipper being greater than the threshold value, generate a control signal to operate the industrial machine with the increased force value operating parameter at the modified value, and in response to detecting an end of the overloaded dipper condition, automatically reduce the increased force value.

21. The controller of claim 20, wherein the suspended load associated with the dipper is an average suspended load of the dipper.

22. The controller of claim 20, wherein the suspended load associated with the dipper is an instantaneous suspended load of the dipper.

23. The controller of claim 20, wherein the actuator is a motor and the force value is a torque of the motor.

* * * * *